US009326597B2

(12) United States Patent
Lukas et al.

(10) Patent No.: US 9,326,597 B2
(45) Date of Patent: May 3, 2016

(54) DEVICE AND METHOD FOR DETECTING A COLLISION OF A DISPLACEABLE FURNITURE PART AND AN OBSTACLE

(75) Inventors: Stefan Lukas, Preding (AT); Guenter Mussbacher, Frauental (AT)

(73) Assignee: LOGICDATA Electronic & Software Entwicklungs GmbH, Deutschlandsberg (AT)

( * ) Notice: Subject to any disclaimer, the term of this patent is extended or adjusted under 35 U.S.C. 154(b) by 0 days.

(21) Appl. No.: 13/516,650

(22) PCT Filed: Dec. 16, 2010

(86) PCT No.: PCT/EP2010/069962
§ 371 (c)(1),
(2), (4) Date: Jun. 15, 2012

(87) PCT Pub. No.: WO2011/083019
PCT Pub. Date: Jul. 14, 2011

(65) Prior Publication Data

US 2012/0247228 A1 Oct. 4, 2012

(30) Foreign Application Priority Data

Dec. 16, 2009 (DE) ..... 10 2009 058 422

(51) Int. Cl.
*G01L 1/00* (2006.01)
*G01L 5/00* (2006.01)
*A47B 9/00* (2006.01)

(52) U.S. Cl.
CPC ..... *A47B 9/00* (2013.01)

(58) Field of Classification Search
CPC .... A47B 9/00; A47B 96/00; A47B 2200/006; A47C 20/04; A61G 7/018; H02P 7/06; B25H 1/16
USPC ..... 73/862.387; 108/20, 161
See application file for complete search history.

(56) References Cited

U.S. PATENT DOCUMENTS

| | | | | |
|---|---|---|---|---|
| 6,977,476 | B2 | 12/2005 | Koch | |
| 7,661,292 | B2 | 2/2010 | Buitmann et al. | |
| 2006/0266791 | A1 * | 11/2006 | Koch et al. | 228/1.1 |
| 2008/0289544 | A1 * | 11/2008 | Buitmann et al. | 108/20 |

FOREIGN PATENT DOCUMENTS

| | | | |
|---|---|---|---|
| AT | 410 626 | B | 6/2003 |
| DE | 10 2006 038 558 | A1 | 4/2008 |
| DE | 10 2007 030 473 | A1 | 1/2009 |
| EP | 1 891 872 | A1 | 2/2008 |
| EP | 1 704 797 | B1 | 8/2011 |
| SE | 516 479 | C2 | 1/2002 |
| WO | WO 03/056976 | A1 | 7/2003 |
| WO | WO 2007/115756 | A2 | 10/2007 |
| WO | WO 2009/003918 | A1 | 1/2009 |

* cited by examiner

*Primary Examiner* — Lisa Caputo
*Assistant Examiner* — Brandi N Hopkins
(74) *Attorney, Agent, or Firm* — Slater Matsil, LLP

(57) ABSTRACT

A device can be used for detecting a collision of a displaceable furniture part and an obstacle. The device includes a controller for a drive device for the displaceable furniture part, and a sensor having a first sensor range and a second sensor range. A force and/or a relative motion arising between the first and second sensor parts can be detected.

20 Claims, 3 Drawing Sheets

DEVICE AND METHOD FOR DETECTING A COLLISION OF A DISPLACEABLE FURNITURE PART AND AN OBSTACLE

The invention relates to a device and a method for detecting a collision of a displaceable furniture part and an obstacle.

Furniture with a displaceable part is used in the residential and work field as well as in the medical field. Height adjustable work tables and desks, workbenches, and hospital and convalescent beds can be mentioned as examples. Beds or recliners with adjustable parts such as a head or foot part, or furniture that supports people with limited mobility in getting up are also examples of furniture with a displaceable part.

The displaceable furniture part is usually not moved manually, but by means of a motor relative to a fixed part of the furniture. When a displaceable furniture part is moved, there can be collisions with obstacles such as walls or other objects, which can lead to damage to the furniture and to the obstacle. The situation becomes critical if persons or animals collide with the displaceable furniture part, which can result in injuries such as crushing injuries. To reduce the risk of injury and damage, it is necessary to detect the collision with an object in order to be able to take suitable measures such as interrupting the movement of the displaceable furniture part after the collision, or moving the displaceable furniture part back.

Collision recognition with entrapment protection is shown in AT 410626, for example, in which motor characteristics are monitored in order to infer a collision. The collision monitoring via motor characteristics limits the circuitry expense, but yields only a limited sensitivity of the collision recognition.

Alternative collision recognition or entrapment protection mechanisms are shown in SE 516479, WO 03/056976 A1, EP 1704797 A1 and EP 1891872 A1. In addition to a controller, these mechanisms require extra sensors, i.e. additional hardware, which is accompanied by an increased expense for installation and wiring of the sensors.

The problem of the invention is to provide an alternative collision recognition.

The problem is solved by a device for collision recognition of a displaceable furniture part and an obstacle. This device comprises a controller for a drive device for the displaceable furniture part and a sensor with a first sensor area and a second sensor area, wherein a force and/or relative motion occurring between the first and the second sensors can be detected.

The first and second sensor areas can be connected to first and second furniture parts, advantageously either the displaceable or the fixed furniture part. There is a mechanical connection between the sensor area and the furniture part, so that a movement or deformation of the furniture part is transmitted onto the sensor part. Advantageously, no relative motion, or only a slight motion, is possible between the sensor area and the furniture part. It should be noted that the connection comprises not only a direct connection but also an indirect one. A connection can be achieved, for example, by screws or by adhesion.

In case of a collision, for example if a table top is pressed against its support during a collision with an obstacle, the furniture parts connected to the sensor areas are deformed or moved relative to one another. The sensor is suitable for detecting a deformation difference between the two furniture parts that occurs in the collision. One furniture part deforms relative to the other furniture part in the collision, so that there is also a force and/or a relative movement between the first and second sensor areas that indicates the collision.

The controller is suitable for signaling a change of movement of the displaceable furniture part—e.g. a stoppage of movement or change in direction—to the drive device for the displaceable furniture part when a collision has been detected. Reducing the speed of motion is also conceivable.

It should be noted that the controller can be constructed to control the drive device in normal operation as well, i.e. the controller initiates and controls the movement of the displaceable furniture part in normal operation and undertakes a change of motion in case of a collision.

Alternatively, the controller is constructed only to provide a stop signal or a movement change signal. Such a controller intervenes in the movement of the displaceable furniture part only in case of a collision. An additional controller component would have to be provided for normal operation that controls the movement of the displaceable furniture part in ordinary operation.

In one embodiment, the first sensor area is connected to the controller. Thus the first sensor area can be connected to the controller while it is being mounted on a furniture part. It is then only necessary to connect the second sensor area to another furniture part.

The sensor is advantageously integrated into the controller, so that the first sensor area is positioned inside the controller housing and only the second sensor area projects to the outside.

The sensor comprises a sensor body that can be constructed monolithically, which is correlated with a simple construction of the sensor. The sensor body serves as a carrier or sheath for the actual sensor element that detects the deformation or movement and converts it into an electrical signal. In one embodiment, the sensor comprises an strain gauge as its sensor element, which is glued onto a metallic sensor body, for example.

In one embodiment, the first sensor area is arranged angularly, preferably substantially rectangularly, relative to the second sensor area so that the sensor areas can be connected to furniture parts that are arranged at an angle relative to one another.

A piece of furniture with the above-described device comprises a first furniture part and a second furniture part, the controller being connected to the first furniture part and the second sensor area to the second furniture part. The furniture parts are advantageously parts of either the displaceable furniture component or the fixed furniture component.

It is also conceivable for the sensor not to be integrated into the controller. One of the sensor areas would then be connected to the first furniture part, and the other sensor area to the second furniture part.

The corresponding method for detecting a collision of a displaceable furniture part and an obstacle provides for detecting a deformation difference and/or a relative motion between a first and a second furniture part.

It is also conceivable to position several sensors at different points of the piece of furniture, such as different points between the table frame and the table top.

Additional advantageous configurations of the invention are specified in the subordinate claims.

The invention will be described below using embodiments with reference to the drawing.

Therein:

FIG. 1 shows a three-dimensional representation of an embodiment of a table frame 1 for a height-adjustable table. For the sake of clarity, illustration of a table top was forgone.

Figure 1:
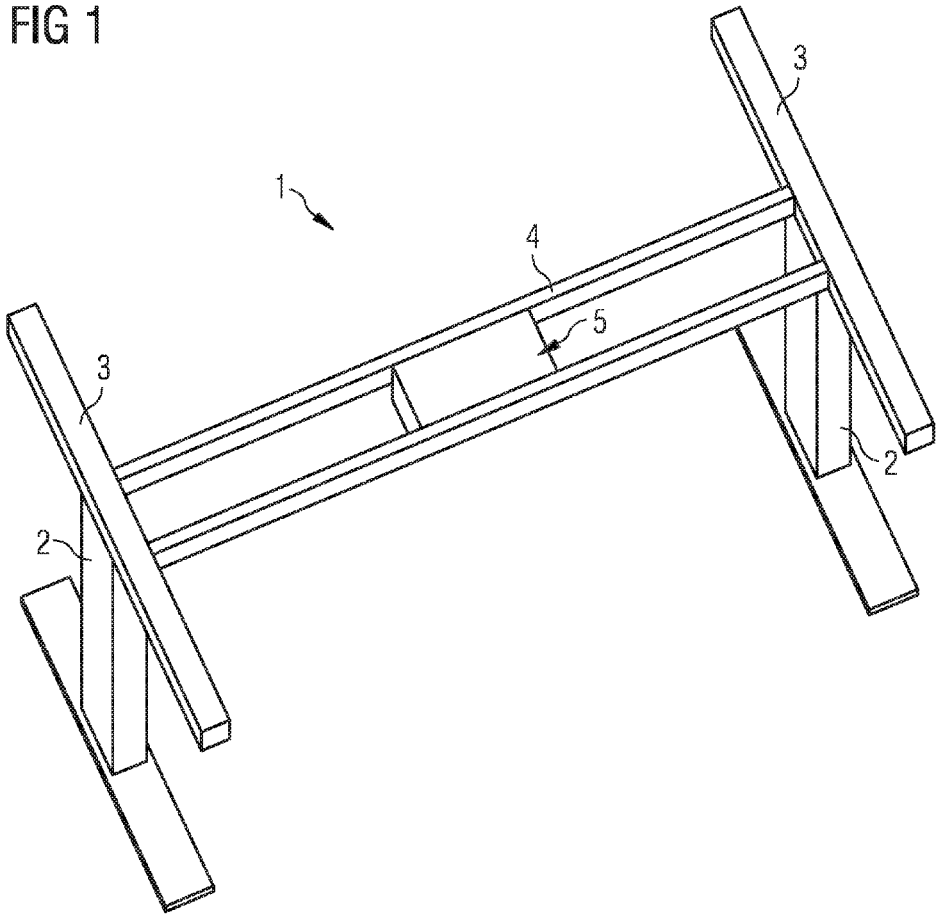
FIG. 1 shows a table frame with which a table top can be raised.

The table frame 1 has two legs 2 with fixed elements and extensible and retractable elements therein for adjusting the height of supports 3 with cross members 4 arranged between them on which the table top rests. A drive device, for example a motor in the legs 2, moves the extensible and retractable elements. A controller 5 is positioned between the cross members 4. The fixed furniture part comprises the fixed elements of the legs 2. The displaceable furniture part comprises the extensible and retractable elements, the supports 3, the cross members 4, the controller 5 and the table top (not shown in FIG. 1).

The controller 5 controls the drive device so that the extensible and retractable elements, and thereby the supports 3 and cross members 4, can be moved. Control signals can be transmitted from the controller 5 by means of cables in or between the cross members 4, for example.

Figure 2:
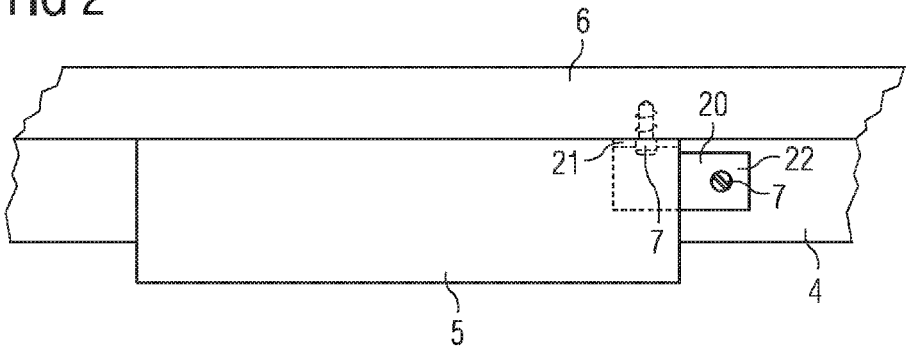
FIG. 2 shows a cutout of a table that can be raised, with a controller and a sensor.

FIG. 2 shows a cutout of an embodiment of the height-adjustable table with a table top 6 that is mounted on the supports 3 (not shown in FIG. 2) and the cross members 4. A device for collision detection comprises the controller 5 as well as a sensor 20 with a first sensor area 21 and a second sensor area 22. The first sensor area 21 is fixedly connected to the controller 5. The first sensor area 21 is connected to the table top 6 by bolting the controller 5 onto the table top 6. The second sensor area 22 is bolted outside the controller 5 onto the cross member 4 or some other metal part of the table frame 1. The sensor 20 can thus measure deformation differences between the table top 6 and the table frame 1. The table top 6 deforms in relation to the table frame 1 due to a collision with an obstacle. This difference is acquired by the sensor 20 and can be detected by an evaluation electronics unit of the controller 5. As soon as a signal is detected from which the occurrence of a collision can be inferred, for example if the force between the first and second sensor areas 21, 22 exceeds a predetermined threshold value, the controller 5 changes the previous movement of the displaceable furniture part, for example, by stopping the movement or by initiating a movement in the opposite direction, so that the displaceable furniture component releases the obstacle or moves away from it.

This device for collision recognition entails a small effort and related low costs, due to the simply constructed sensor 20. The sensor 20, for example, can be a simple metal angle bracket with an elongation measurement strip. Alternatively, a load cell with an strain gauge can be provided. Since the sensor 20 is fixedly connected to the controller 5, the controller 5 and the sensor 20 can be installed in a simple manner and there is no additional wiring expense. An amplifier element can be integrated on the control board, so that no additional electronics outside the controller 5 are necessary. Because the sensor 20 does not measure the entire weight of the table top, but only the force between the table top 6 and the table frame 1, the table can be constructed in the ordinary manner, rigidly for example, since the sensor 20 also detects relative forces and/or deformations between the sensor areas 21, 22.

Figure 3:
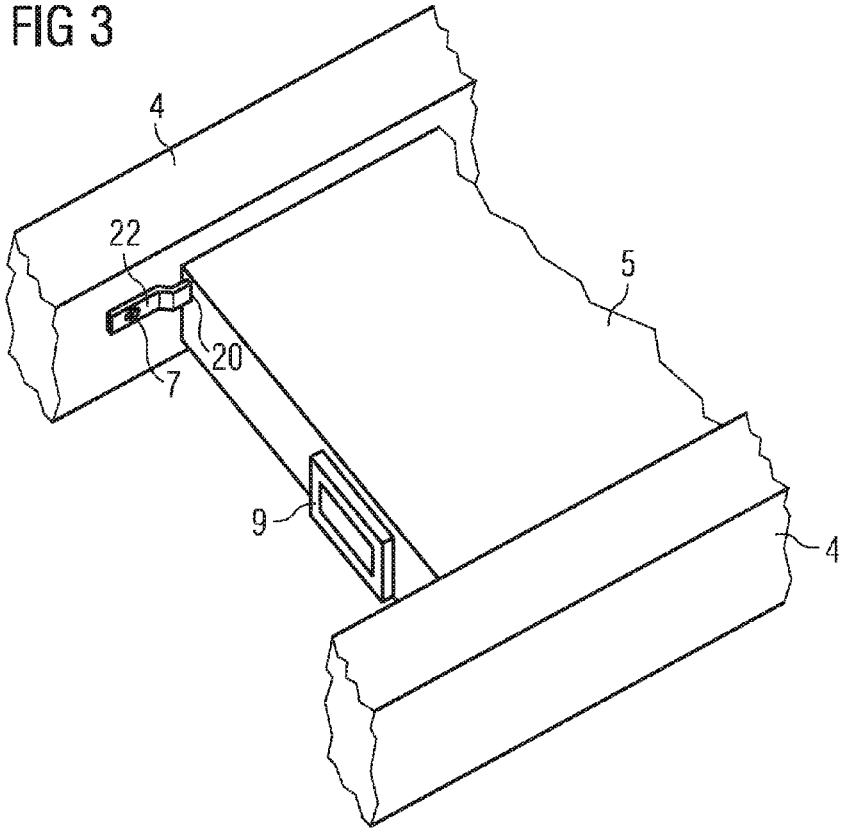
FIG. 3 shows a cutout of the controller with an integrated sensor that is mounted in the table that can be raised.

FIG. 3 shows a three-dimensional representation of a cutout from one embodiment of a height-adjustable table, whose table top is not shown for the sake of clarity.

A controller 5 is arranged between the cross members 4 of the table frame. The sensor 20 is integrated into the controller 5, so that the first sensor area is arranged inside the housing of controller 5. The second sensor area 22 projects outward and is affixed to one of the cross members 4 by a screw 7. The controller 5 is connected to the table top (not shown in FIG. 6) so that the first sensor area is also connected to the table top in this manner.

In case of a collision with an obstacle, a force and/or relative motion that appears between the first and second sensor areas 21, 22 is detected and the controller 5 signals the drive unit (not shown in FIG. 3) to stop the movement or to change the direction of motion of the displaceable furniture component. The signaling can be accomplished via a cable for transmitting electrical or optical signals that is connected to an interface 9 of the controller 5.

Figure 4:
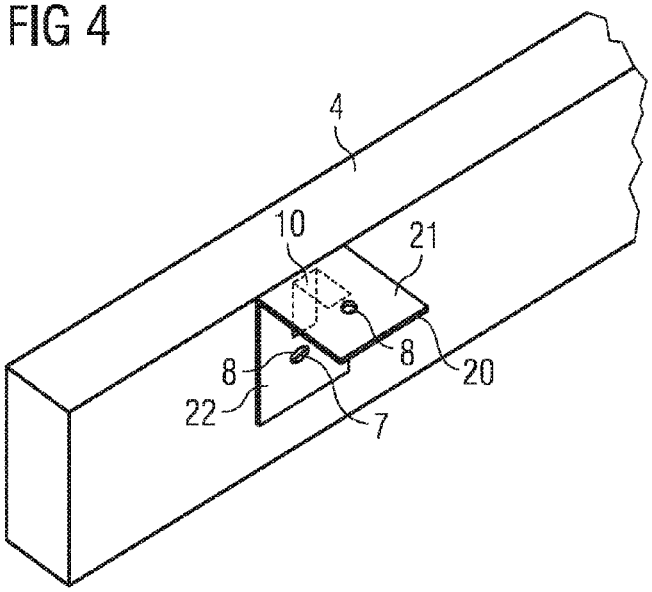
FIG. 4 shows an embodiment of a sensor mounted on a piece of furniture.

FIG. 4 shows the mounting of a metal angle bracket with an strain gauge 10 that serves as a sensor 20. The metal angle bracket serves as the sensor body to which the strain gauge 10 is affixed. The metal angle bracket has a first tab, which is the first sensor area 21, with a hole 8 for mounting, and a second tab, which is the second sensor area 22, with a hole 8 for mounting. The strain gauge 10 can extend from one tab to the other across the angled area. The second sensor area 22 is affixed to the cross member 4 by means of a screw 7. The first sensor area 21 in this embodiment is affixed to the table top (not shown in FIG. 4). In this embodiment, the sensor 20 is not integrated into the controller 5 (not shown in FIG. 4). The sensor signal, however, can be supplied to the latter via a cable (not shown in FIG. 4).

Figure 5:
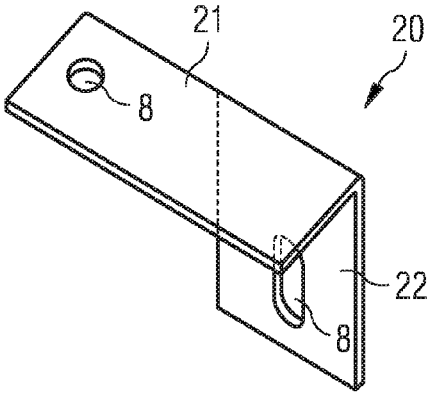
FIGS. 5-7 show additional embodiments of a sensor.

FIG. 5 shows another embodiment of a sensor 20. The strain gauge is not shown in this embodiment for the sake of clarity; it can be provided on an upper side of the sensor 20, for example, or integrated into the sensor 20.

The sensor 20 is constructed as a metal angle bracket and comprises a flat rectangular first sensor area 21 and a flat rectangular second sensor area 22, between which there is a right or nearly-right angle. Such a sensor body can be punched out as an L-shaped plate from a metal plate and bent into shape by a single angle bend. One of the sensor areas 21, 22 can be mounted on the table top, for example, and the other on a furniture part perpendicular thereto such as the cross member. Holes 8 are provided in the sensor areas 21, 22 for mounting. It is also conceivable, however, to connect the sensor 20 to the furniture parts in some other manner, such as gluing.

A sensor 20 of this type can be fixedly connected to the controller 5, for example by being screwed onto the controller 5. A sensor area can be mounted on the exterior of the controller, bolted onto it for example, or integrated into the interior of the housing, so that one of the sensor areas 21, 22 is outside the housing. It is also conceivable, however, to mount this sensor 20 outside the controller and transmit the sensor signal via a cable running to the controller.

Figure 6:
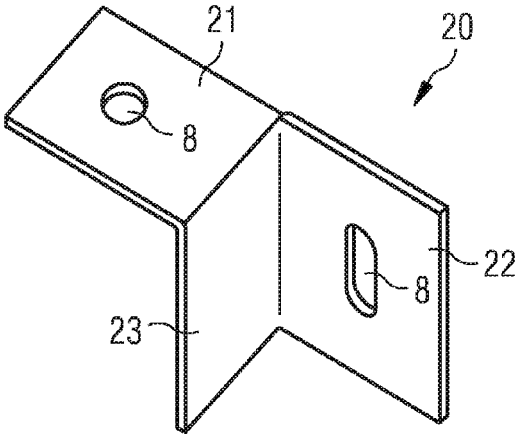

The embodiment shown in FIG. 6 shows a sensor 20 with a first and a second sensor area 21, 22 that are arranged at an angle relative to one another. In this embodiment, a connecting area 23 is arranged between the first and second sensor areas 21, 22. The first sensor area 21 is arranged at an angle relative to a first edge of the connecting area 23. The second sensor area 22 is arranged at angle relative to an edge of the connecting area 23 perpendicular to the above edge. Such a sensor body can be bent into shape by doubly angle-bending an L-shaped plate. The strain gauge(not shown in FIG. 6) can run from the first sensor area 21 via the connecting area 23 to the second sensor area 22, or only over one of the areas, for example the connecting area 23, or over two of the areas 21, 22, 23.

Figure 7:
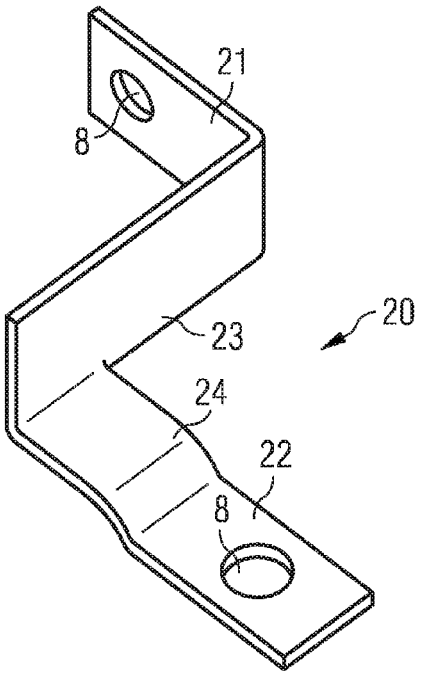

FIG. 7 shows another example of a sensor 20 with a first and second sensor area 21, 22, between which a connecting area 23 is provided. One part 24 of the second sensor area, adjacent to the connecting area 23, is bent or curved in the form of a circular segment, so that the second sensor area 22 is flexible, which facilitates mounting.

It should be noted that the characteristics of the embodiments can be combined with one another.

REFERENCE NUMBERS

1 Table frame
2 Leg
3 Support
4 Cross member
5 Controller
6 Table top
7 Screw
8 Hole
9 Interface
10 Strain gauge
20 Sensor
21 First sensor area
22 Second sensor area
23 Connection area
24 Curved area

The invention claimed is:

1. A device for detecting a collision of a first displaceable furniture part and an obstacle, the first displaceable furniture part being a table top, the device comprising:

a controller for a drive device for the first displaceable furniture part; and a sensor comprising a monolithic sensor body formed from a single piece having a first sensor area connected to the first displaceable furniture part, a second sensor area connected to a second furniture part and an angled area, wherein the second furniture part is a table frame, wherein the sensor is configured to detect a force or relative movement occurring between the first and second sensor areas, the force or the relative movement being transmitted by movement or deformation of the first displaceable furniture part relative to the second furniture part, wherein the first sensor area is arranged at an angle relative to the second sensor area, wherein a strain gauge extends across the angled area of the sensor body, and wherein the first sensor area is attached to the first displaceable furniture part but not to the second furniture part, and wherein the second sensor area is attached to the second furniture part but not to the first displaceable furniture part.

2. The device according to claim 1, wherein the first sensor area is connected to the controller.

3. The device according to claim 1, wherein the sensor is integrated at least partially into the controller.

4. The device according to claim 1, wherein the sensor body comprises a metallic sensor body.

5. The device according to claim 1, wherein the first sensor area is directly connected to the first displaceable furniture part, and wherein the second sensor area is directly connected to the second furniture part.

6. The device according to claim 1, wherein the angled area is located between and connects the first sensor area and the second sensor area.

7. The device according to claim 6, wherein the angled area comprises a substantially right angle.

8. A furniture comprising:

a first displaceable furniture part, wherein the first displaceable furniture part is a table top;

a second furniture part, wherein the second furniture part is a table frame;

a drive device configured to drive the first displaceable furniture part;

a controller electrically connected to the drive device, the controller configured to control the drive device; and a sensor comprising a monolithic sensor body formed from a single piece having a first sensor area connected to the first displaceable furniture part, a second sensor area connected to the second furniture part and an angled area, wherein the sensor is configured to detect a force or relative movement occurring between the first and second sensor areas, the force or the relative movement being transmitted by movement or deformation of the first displaceable furniture part relative to the second furniture part, wherein the first sensor area is arranged at an angle relative to the second sensor area, wherein a strain gauge extends across the angled area of the sensor body, wherein the first sensor area is attached to the first displaceable furniture part but not to the second furniture part, and wherein the second sensor area is attached to the second furniture part but not to the first displaceable furniture part.

9. The furniture according to claim 8, wherein the first sensor area is connected to the controller.

10. The furniture according to claim 8, wherein the sensor is integrated at least partially into the controller.

11. The furniture according to claim 8, wherein the first sensor area is directly connected to the first displaceable furniture part, and wherein the second sensor area is directly connected to the second furniture part.

12. The furniture according to claim 8, wherein the angled area is located between and connects the first sensor area and the second sensor area.

13. The furniture according to claim 12, wherein the angled area comprises a substantially right angle.

14. A method for detecting a collision of a displaceable furniture part and an obstacle, the method comprising:

detecting a deformation difference or a relative movement between a first furniture part and a second furniture part, wherein the deformation difference or relative movement occurs between a first sensor area connected to the first furniture part and a second sensor area connected to the second furniture part, wherein the first furniture part is a table top, and wherein the second furniture part is a table frame; and sensing by a sensor the deformation difference or the relative movement between the first furniture part and the second furniture part, wherein the sensor comprises a monolithic sensor body formed from a single piece, the monolithic sensor body comprising the first sensor area, the second sensor area and an angled area, wherein the sensor further comprises a strain gauge extending across the angled area of the sensor body, wherein the first sensor area is arranged at an angle relative to the second sensor area, and wherein the angled area is located between and connects the first sensor area and the second sensor area.

15. The method according to claim 14, wherein the deformation difference or the relative movement is detected by a sensor integrated at least partially into a controller for a drive device of the first or second furniture part.

16. The method according to claim 14, wherein the first sensor area is attached to the first furniture part but not to the second furniture part, and wherein the second sensor area is attached to the second furniture part but not to the first furniture part.

17. The method according to claim 14, wherein the angled area comprises a substantially right angle.

18. A device for detecting a collision of a first displaceable furniture part and an obstacle, the first displaceable furniture part being a table top, the device comprising:

a controller for a drive device for the first displaceable furniture part; and a sensor comprising a monolithic sensor body formed from a single piece having a first sensor area connected to the first displaceable furniture part, a second sensor area connected to a second furniture part and an angled area, wherein the second furniture part is a table frame, wherein the sensor is configured to detect a force or relative movement occurring between the first and second sensor areas, the force or the relative movement being transmitted by movement or deformation of the first displaceable furniture part relative to the second furniture part, wherein the first sensor area is arranged at an angle relative to the second sensor area, wherein a strain gauge extends across the angled area of the sensor body, and wherein the angled area is located between and connects the first sensor area and the second sensor area.

19. A furniture comprising:

a first displaceable furniture part, wherein the first displaceable furniture part is a table top;

a second furniture part, wherein the second furniture part is a table frame;

a drive device configured to drive the first displaceable furniture part;

a controller electrically connected to the drive device, the controller configured to control the drive device; and a sensor comprising a monolithic sensor body formed from a single piece having a first sensor area connected to the first displaceable furniture part, a second sensor area connected to the second furniture part and an angled area, wherein the sensor is configured to detect a force or relative movement occurring between the first and second sensor areas, the force or the relative movement being transmitted by movement or deformation of the first displaceable furniture part relative to the second furniture part, wherein the first sensor area is arranged at an angle relative to the second sensor area, wherein a strain gauge extends across the angled area of the sensor body, and wherein the angled area is located between and connects the first sensor area and the second sensor area.

20. A method for detecting a collision of a displaceable furniture part and an obstacle, the method comprising:

detecting a deformation difference or a relative movement between a first furniture part and a second furniture part, wherein the deformation difference or relative movement occurs between a first sensor area connected to the first furniture part and a second sensor area connected to the second furniture part, wherein the first furniture part is a table top, and wherein the second furniture part is a table frame; and sensing by a sensor the deformation difference or the relative movement between the first furniture part and the second furniture part, wherein the sensor comprises a monolithic sensor body formed from a single piece, the monolithic sensor body comprising the first sensor area, the second sensor area and an angled area, wherein the sensor further comprises a strain gauge extending across the angled area of the sensor body, wherein the first sensor area is arranged at an angle relative to the second sensor area, wherein the first sensor area is attached to the first furniture part but not to the second furniture part, and wherein the second sensor area is attached to the second furniture part but not to the first furniture part.

* * * * *